US005869215A

United States Patent [19]

Ong et al.

[11] Patent Number: 5,869,215

[45] Date of Patent: Feb. 9, 1999

[54] TONER COMPOSITIONS AND PROCESSES THEREOF

[75] Inventors: Beng S. Ong; Walter Mychajlowskij, both of Mississauga; Patricia A. Burns, Milton; Raj D. Patel; David J. Sanders, both of Oakville, all of Canada

[73] Assignee: Xerox Corporation, Stamford, Conn.

[21] Appl. No.: 6,508

[22] Filed: Jan. 13, 1998

[51] Int. Cl.[6] ..... G03G 9/087

[52] U.S. Cl. ..... 430/137

[58] Field of Search ..... 430/137

[56] References Cited

U.S. PATENT DOCUMENTS

| | | | |
|---|---|---|---|
| 4,137,188 | 1/1979 | Uetake et al. | 252/62.54 |
| 4,558,108 | 12/1985 | Alexandru et al. | 526/340 |
| 4,797,339 | 1/1989 | Maruyama et al. | 430/109 |
| 4,983,488 | 1/1991 | Tan et al. | 430/137 |
| 4,996,127 | 2/1991 | Hasegawa et al. | 430/109 |
| 5,066,560 | 11/1991 | Tan et al. | 430/137 |
| 5,278,020 | 1/1994 | Grushkin et al. | 430/137 |
| 5,290,654 | 3/1994 | Sacripante et al. | 430/137 |
| 5,308,734 | 5/1994 | Sacripante et al. | 430/137 |
| 5,344,738 | 9/1994 | Kmiecik-Lawrynowicz et al. | 430/137 |
| 5,346,797 | 9/1994 | Kmiecik-Lawrynowicz et al. | 430/137 |
| 5,348,832 | 9/1994 | Sacripante et al. | 430/109 |
| 5,364,729 | 11/1994 | Kmiecik-Lawrynowicz et al. | 430/137 |
| 5,366,841 | 11/1994 | Patel et al. | 430/137 |
| 5,370,963 | 12/1994 | Patel et al. | 403/137 |
| 5,403,693 | 4/1995 | Patel et al. | 430/137 |
| 5,405,728 | 4/1995 | Hopper et al. | 430/137 |
| 5,418,108 | 5/1995 | Kmiecik-Lawrynowicz et al. | 430/137 |
| 5,496,676 | 3/1996 | Croucher et al. | 430/137 |
| 5,501,935 | 3/1996 | Patel et al. | 430/137 |
| 5,527,658 | 6/1996 | Hopper et al. | 430/137 |
| 5,585,215 | 12/1996 | Ong et al. | 430/107 |
| 5,593,807 | 1/1997 | Sacripante et al. | 430/137 |
| 5,648,193 | 7/1997 | Patel et al. | 430/137 |
| 5,650,255 | 7/1997 | Ng et al. | 430/137 |
| 5,650,256 | 7/1997 | Veregin et al. | 430/137 |
| 5,658,704 | 8/1997 | Patel et al. | 430/137 |
| 5,660,965 | 8/1997 | Mychajlowski et al. | 430/137 |

*Primary Examiner*—Roland Martin
*Attorney, Agent, or Firm*—E. O. Palazzo

[57] ABSTRACT

A process for the preparation of toner including (i) blending an aqueous colorant dispersion with a latex blend comprised of a linear polymer and a soft crosslinked polymer;

(ii) heating the resulting mixture at about below, or about equal to the glass transition temperature (Tg) of the linear latex polymer to form aggregates; and (iii) subsequently heating said aggregate suspension about above, or about equal to the Tg of the linear latex polymer to effect fusion or coalescence of said aggregates.

27 Claims, No Drawings

TONER COMPOSITIONS AND PROCESSES THEREOF

PENDING APPLICATIONS AND PATENTS

Illustrated in copending applications U.S. Ser. No. 825,451, now U.S. Pat. No. 5,763,133, and U.S. Ser. No. 841,300, now U.S. Pat. No. 5,747,215, the disclosures of which are totally incorporated herein by reference, are emulsion/aggregated toners and processes thereof. More specifically, there is illustrated in this patent a process for the preparation of toner comprising (i) blending (a) an aqueous pigment dispersion containing a first ionic surfactant and an optional charge control agent with (b) a latex blend comprised of linear polymer and crosslinked polymer particles, optional nonionic surfactant and a second ionic surfactant with a charge polarity opposite to that of said first ionic surfactant in said pigment dispersion;

(ii) heating the resulting mixture at about below the glass transition temperature (Tg) of the linear latex polymer to form toner sized aggregates; and (iii) subsequently heating said aggregate suspension about above the Tg of the linear latex polymer to effect fusion or coalescence of said aggregates.

Although the toners of the above patent exhibit low fusing temperatures, they are generally higher than the toners of the present invention for the same degree of crosslinked latex incorporation. The toners of the copending application may also exhibit low image gloss characteristics.

The following copending applications, the disclosures of which are totally incorporated herein by reference, are being filed concurrently herewith.

U.S. Ser. No. 006,622 discloses a toner process wherein a colorant is flushed into a sulfonated polyester, followed by the addition of an organic soluble dye and an alkali halide solution.

U.S. Ser. No. 006,612 discloses a toner process with a first aggregation of sulfonated polyester, and thereafter, a second aggregation with a colorant dispersion and an alkali halide.

U.S. Ser. No. 006,640 discloses a toner process wherein a latex emulsion and a colorant dispersion are mixed in the presence of an organic complexing agent or compound, and wherein the latex can contain a sodio sulfonated polyester resin.

U.S. Ser. No. 006,521 discloses an emulsion/aggregation/fusing process for the preparation of a toner containing a resin derived from the polymerization of styrene butadiene, acrylonitrile, and acrylic acid.

U.S. Ser. No. 006,553 discloses a toner process wherein there is mixed an emulsion latex, a colorant dispersion, and a monocationic salt, and wherein the resulting mixture possesses an ionic strength of about 0.001 molar to about 5 molar.

U.S. Ser. No. 006,299 discloses a toner process wherein there is mixed an emulsion latex and colorant dispersion, and wherein the colorant dispersion is stabilized with submicron sodio sulfonated polyester resin particles, and wherein the latex resin can be a sodio sulfonated polyester.

U.S. Ser. No. 006,742 discloses a toner process wherein there is mixed an aqueous colorant dispersion and an emulsion latex, followed by filtering, and redispersing the toner formed in water at a pH of above about 7 and contacting the resulting mixture with a metal halide or salt and then with a mixture of an alkaline base and a salicylic acid, a catechol, or mixtures thereof.

The appropriate components and process variations of the above copending applications may be selected for the present invention in embodiments thereof.

BACKGROUND OF THE INVENTION

The present invention is generally directed to toner processes, and more specifically, to chemical processes wherein there is accomplished the aggregation and fusion or coalescence of latex, colorants, preferably pigment particles, and optional additives to provide toner compositions. In embodiments, the present invention is directed to a chemical toner process wherein known toner pulverization and classification methods are avoided, and wherein in embodiments toner compositions with a volume average diameter of from about 1 to about 20, and preferably from about 2 to about 10 microns in volume average diameter, and narrow particle size distribution of, for example, less than 1.35, and more specifically, from about 1.10 to about 1.25, both as measured on the Coulter Counter can be obtained. The resulting toners can be selected for known electrophotographic processes, including digital processes, and particularly color xerographic imaging and printing processes.

In xerographic color systems, small sized toners of preferably from about 2 to about 7 microns are important to the achievement of high image quality. It is also equally important to have a low image pile height to eliminate, or minimize image feel and to avoid, or minimize paper curling after fusing. Paper curling can be particularly pronounced in xerographic color processes in which relatively high toner coverage as a result of the application of three to four color toners are utilized. During fusing, moisture is driven off from the substrate like paper due to high fusing temperatures of from about 150° C. to 200° C. With only one layer of toner, such as in a single black color, or in highlight color xerographic applications, the amount of moisture driven off during fusing can be reabsorbed back by paper and the resulting print remains relatively flat with minimal paper curl. In process color where toner coverage is high, the relatively thick toner plastic covering on paper can inhibit the paper from reabsorbing the moisture, and lead to substantial paper curling. These and other imaging shortfalls and problems are avoided or minimized with the toners and processes of the present invention.

It is preferable to use small toner particle sizes such as from about 2 to about 7 microns, and with higher pigment loading, such as from about 4 to about 15 percent by weight of toner, so that the mass of toner necessary for attaining the required optical density and color gamut can be significantly reduced to eliminate or minimize image feel and paper curl. The use of lower toner mass also ensures the achievement of image uniformity. Toners prepared in accordance with the present invention enable in embodiments these aforementioned advantages and permit the use of low fusing temperatures, such as from about 100° C. to about 170° C., which will also eliminate or minimize the paper curling.

PRIOR ART

There is illustrated in U.S. Pat. No. 4,996,127 a toner of associated particles of secondary particles comprising primary particles of a polymer having acidic or basic polar groups and a coloring agent. The polymers selected for the toners of the '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. In U.S. Pat. No. 4,983,488, there is disclosed a process for the preparation of toners by the polymerization of a polymerizable monomer dispersed by emulsification in the presence of a colorant and/or a magnetic powder to prepare a principal resin component and then effecting coagulation of the resulting polymerization liquid in such a manner that the particles in the liquid after coagulation have diameters suitable for a toner. Furthermore, there is illustrated in U.S. Pat. No. 4,797,339, a process for the preparation of toners by resin emulsion polymerization, wherein similar to the '127 patent certain polar resins are selected.

Emulsion/aggregation/coalescence processes for the preparation of toners are illustrated in a number of Xerox Corporation patents, the disclosures of which are totally incorporated herein by reference, such as U.S. Pat. No. 5,290,654, U.S. Pat. No. 5,278,020, U.S. Pat. No. 5,308,734, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797; and also of interest may be U.S. Pat. Nos. 5,348,832; 5,405,728; 5,366,841; 5,496,676; 5,527,658; 5,585,215; 5,650,255; 5,650,256 and 5,501,935 (spherical toners). The appropriate components and processes of these Xerox patents may be selected for the present invention in embodiments.

SUMMARY OF THE INVENTION

Examples of the features of the present invention in embodiments thereof include:

It is an feature of the present invention to provide toner processes with many of the advantages illustrated herein.

In another feature of the present invention there are provided direct processes for the preparation of black and colored toner compositions with, for example, a small size of about 2 to about 10 microns and narrow GSD of less than 1.35, and more specifically, between about 1.10 to about 1.25.

A further feature of the present invention is the provision of colored toner compositions with excellent colorant dispersion, thereby enabling excellent color mixing quality and excellent projection efficiency.

Still in a further feature of the present invention there are provided toner preparative processes for colored toner compositions which provide excellent image gloss uniformity in process color copies and prints.

In a further feature of the present invention there is provided a process for the preparation of toner compositions with a toner size of from between about 1 to about 15 microns, and preferably from about 2 to about 7 microns in volume average particle diameter, and a narrow particle size distribution of less than about 1.35 and preferably between about 1.10 and about 1.25 as measured by a Coulter Counter, and which toner compositions can permit lower fusing temperature characteristics.

Another feature is the provision of a chemical process for the preparation of toner compositions with low fusing temperatures comprising the aggregation and coalescence of two latexes, one comprised of linear polymer particles, and one comprised of soft crosslinked polymer particles and colorant, and wherein the toner particle size is achieved, for example, by proper control of reaction temperature.

In an associated feature of the present invention there are provided toner compositions which enable lower fusing temperatures of from about 100° C. to about 170° C., and which toners possess excellent toner blocking resistance.

A further feature of the present invention is the provision of toner compositions which offer excellent image quality in high speed color copying and printing processes.

In yet a further feature of the present invention there is provided a toner derived from a linear latex polymer, a soft crosslinked latex polymer, colorant, and optional additives, and wherein the toner has a narrow particle size distribution of less than about 1.35, and preferably between 1.10 and 1.25 without the utilization of conventionally known classification techniques.

Moreover, in another feature of the present invention there are provided toner compositions with excellent image projection efficiency, such as from about 65 to over 85 percent as measured by the Match Scan II spectrophotometer available from Milton-Roy.

In an additional feature of the present invention there are provided toner compositions which when fused on paper, do not cause objectionable paper curl.

In embodiments, the present invention relates to toners and processes thereof. More specifically, the present invention, is directed to toner processes wherein there is selected the aggregation of latexes, colorant, and additive particles to form toner sized aggregates, followed by fusion or coalescence of the components of the aggregates to form integral toner particles, and wherein the temperature of aggregation may be employed to control the aggregate size, and thus the final toner size, and wherein there is selected a mixture of two latexes, one a linear polymer, and the second a soft crosslinked polymer for incorporation into the toner composition.

Soft, such as soft crosslinked polymer, refers, for example, to flexible, and the addition of and presence of an acrylate, such as butyl acrylate, in amounts of greater than about 20, from about 20 to about 70 weight percent, and more specifically, from about 25 to about 55 weight percent based on the amount of monomers in the latex. The use of soft crosslinked polymers permits a number of advantages, such as a lower toner fusing temperature, for example a toner fusing temperature of about 130° C. to about 145° C. as compared to wherein hard crosslinked polymers are selected and the toner fusing temperature is higher, such as about 150° C., or higher.

The present invention relates to a process for the preparation of toner comprising (i) blending an aqueous colorant dispersion with a latex blend comprised of a linear polymer and soft crosslinked polymer particles;

(ii) heating the resulting mixture at about below, or about equal to the glass transition temperature (Tg) of the linear latex polymer to form aggregates; and (iii) subsequently heating said aggregate suspension about above, or about equal to the Tg of the linear latex polymer to effect fusion or coalescence of the aggregates; a process wherein the colorant dispersion contains an ionic surfactant, and the latex blend contains an optional nonionic surfactant, and an ionic surfactant that is of opposite charge polarity to that of the ionic surfactant in the colorant dispersion; a process wherein the linear latex polymer is poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly (styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), or poly(alkyl acrylate-acrylonitrile-acrylic acid); a process wherein the crosslinked polymer is the crosslinked analog of the linear polymer containing a high proportion of a soft monomer of propyl, butyl acrylate, pentyl acrylate, hexyl acrylate, ethylhexyl acrylate, 1,3-diene, hexyl methacrylate, or mixtures thereof; a process wherein the crosslinked polymer is a crosslinked poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly (styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), or poly(alkyl acrylate-acrylonitrile-acrylic acid); a process wherein the crosslinked polymer is derived from the polymerization of styrene, butyl acrylate, acrylic acid and divinylbenzene; a process wherein the crosslinked polymer is derived from polymerization of monomers selected from the group consisting of styrenes, acrylates, methacrylates, 1,3-dienes, acrylonitrile, acrylic acid, and methacrylic acid in the presence of a crosslinking compound; a process wherein butyl acrylate is present in an amount of about 20 to about 50 percent by weight of the monomers; a process wherein the crosslinked polymer is derived from polymerization of styrene, butadiene or isoprene, acrylic acid and divinylbenzene; a process wherein the butadiene or isoprene is present in an amount of about 20 to about 50 percent by weight of the monomers; a process wherein the crosslinked polymer particles are present in an amount of from about 5 to about 75 weight percent of the toner composition, and wherein the linear polymer is present in an amount of from about 25 to about 95 weight percent of toner composition; a process wherein the crosslinked polymer particles are present in an amount of from about 10 to about 50 weight percent of toner composition, and wherein the linear polymer is present in an amount of from about 50 to about 90 weight percent of toner composition; a process wherein the toner exhibits low fusing temperature of from about 120° C. to about 145° C.; a process wherein the colorant dispersion contains a cationic surfactant, and the latex blend contains a nonionic surfactant and an anionic surfactant; a process wherein the colorant dispersion contains an anionic surfactant and the latex blend contains a nonionic surfactant and a cationic surfactant; a process wherein the aggregation (ii) is accomplished at temperatures of from about 25° C. to about 1° C. below the Tg of the linear polymer for a duration of from about 0.5 hour to about 5 hours; a process wherein the linear polymer is poly(styrene-butyl acrylate), poly(styrene-butyl acrylate-acrylic acid), poly(styrene-butadiene), poly(styrene-butadiene-acrylic acid), poly(styrene-butyl acrylate-acrylonitrile), or poly(styrene-butyl acrylate-acrylonitrile-acrylic acid), and the crosslinked resin is the crosslinked derivative of poly(styrene-butyl acrylate), poly (styrene-butyl acrylate-acrylic acid), poly(styrene-butadiene), poly(styrene-butadiene-acrylic acid), poly (styrene-butyl acrylate-acrylonitrile), or poly(styrene-butyl acrylate-acrylonitrile-acrylic acid); a process wherein the nonionic surfactant is selected from the group consisting of polyvinyl alcohol, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, and dialkylphenoxy poly(ethyleneoxy)ethanol, and wherein the anionic surfactant is selected from the group consisting of sodium dodecyl sulfate, sodium dodecylbenzene sulfate, sodium dodecylnaphthalene sulfate, and the cationic surfactant is a quaternary ammonium salt; a process wherein the colorant is carbon black, magnetite, cyan, yellow, magenta, and mixtures thereof; a process wherein the surfactants are each present in an effective amount of from about 0.1 to about 5 weight percent of the reaction mixture; a process wherein there is added to the surface of the formed toner metal salts, metal salts of fatty acids, silicas, metal oxides, or mixtures thereof each in an amount of from about 0.1 to about 10 weight percent of the obtained toner particles; a process wherein after cooling the toner is isolated, washed with water or an aqueous base solution at a temperature of from about 25° C. to about 75° C. to remove the residual surfactants from the toner, and wherein the fusion or coalescence is accomplished at a temperature of from about 65° C. to about 100° C.; a process wherein subsequent to (iii) cooling is accomplished, and the toner is isolated, washed, and dried; a process for the preparation of toner comprising heating a mixture of an aqueous colorant dispersion containing a first ionic surfactant, and a latex blend comprised of linear polymer and crosslinked polymer particles, a nonionic surfactant and a second ionic surfactant with a charge polarity opposite to that of the ionic surfactant in the colorant dispersion; heating the resulting mixture at about below the glass transition temperature (Tg) of the linear latex polymer to form toner sized aggregates, and subsequently heating the aggregates about above the Tg of the linear latex polymer to effect coalescence of the aggregates, followed by optionally isolating the toner, and optionally washing the toner; and a process wherein the crosslinked polymer particles are present in amounts of from about 5 percent to about 75 percent by weight of the toner, and wherein the linear polymer particles are present in an amount of from about 25 to about 95 by weight of the toner.

Processes of present invention relate to aggregating a colorant, preferably pigment and optional additives, with a latex emulsion comprised of a mixture of linear and soft crosslinked polymer particles, and wherein the soft crosslinked polymer particles have a glass transition temperature (Tg), preferably lower, for example, than that of the linear latex polymer, such as less than about 70° C., followed by coalescing or fusing together the components of the aggregates to enable formation of integral toner particles comprised of polymer, crosslinked polymer particles, colorant, preferably pigment particles and optional additives. The fusing characteristics of the toner compositions of the present invention in embodiments are controlled by the amount of the linear latex polymer, and the amount of crosslinked latex polymer particles, their particle size, crosslinking density, Tg, and other components of the composition. Specifically, improved fusing characteristics, such as lower fusing temperatures of from about 100° C. to about 170° C., can be achievable with the toners having incorporated therein soft crosslinked polymer particles or polymer particles possessing a Tg of preferably less than about, or equal to about 70° C., and more specifically, less than about, or equal to about 55° C. A significant reduction in fusing temperature of about 5° C. to about 30° C. can thus be obtained when the crosslinked polymer particles are incorporated into the toner composition. The degree of fusing temperature reduction depends largely on the percentage of crosslinked latex incorporation, the polymer composition, crosslinking density, and Tg. In general, the lower the Tg, the lower the fusing temperature. In embodiments of the present invention, the toner process is comprised of aggregating a colorant dispersion and optional additives with two types of latex polymer particles, one comprised of linear polymer particles and the second being comprised of soft crosslinked polymer particles comprised of from about 20 weight percent to about over 50 weight percent of soft monomers like n-butylacrylate or n-hexylacrylate at a temperature below about the Tg of the linear latex polymer, for example from about 25° C. to about 1° C. below about the resin Tg, to form toner sized aggregates, and wherein the crosslinked latex polymer has a Tg of preferably about 70° C. or less, for example from about 10° C. to about 55° C., followed by coalescing or fusing together the constituents of the aggregates to permit formation of mechanically stable toner particles by heating at a temperature of, for example, from about 10° C. to about 50° C. above about the Tg of the linear latex polymer for an effective time period of, for example, from about 30 minutes to about 10 hours. The latexes that are utilized in the process of the present invention generally contain an ionic surfactant and an optional nonionic surfactant, and the colorant, like pigment dispersion, contains an ionic surfactant, such as a cationic surfactant, that is of an opposite charge polarity to the ionic surfactant in the latex emulsions. The mixing of the latex resin with the colorant dispersion results in flocculation of the latex and colorant particles, which flocculent mixture on gentle stirring with controlled heating, enables the formation of toner sized aggregates with a narrow aggregate size distribution. The latex resin size is generally in the range of from, for example, about 0.05 micron to about 1 micron in volume average diameter, while the colorant size is, for example, from about 0.05 micron to about 1.0 micron. The amount of each of the ionic surfactants utilized in the process in embodiments is from about 0.01 to about 5 weight percent, and the nonionic surfactant present in the latex emulsion is in the amount of from about 0 to 5 weight percent of the total reaction mixture. The resulting toners in embodiments exhibit lower fusing temperatures than, for example, those of the toners of the copending application recited hereinbefore. Generally, the minimum fusing temperature is from about 100° C. to about 175° C., the exact fusing temperature depending, for example, on the fusing conditions, such as the dwell time, the fuser roll material, the fuser oil, the rate of fuser oil application, and the substrate, to name a few. The ability to reduce the fusing temperature of a toner with crosslinked latex particles eliminates the need to redesign the toner resin for new toners, thus enabling the rapid, cost efficient development of these new toners. Lower toner fusing temperatures would also enable lower fuser temperatures, thus prolonging the fuser roll life, and eliminating the paper curl problem associated with fusing at high temperatures. At a given fuser temperature, the lower toner fusing temperature property also enables faster printing or copying speed without comprising image quality.

More specifically, the present invention is directed to a chemical toner preparative process comprised of first blending an aqueous colorant dispersion containing a colorant, such as HELIOGEN BLUE™ or HOSTAPERM PINK™, and a cationic surfactant, such as benzalkonium chloride (SANIZOL B-50™), with a latex blend containing two latices, one comprised of linear polymer particles, and the other, or second comprised of soft crosslinked polymer particles, stabilized with an anionic surfactant, such as sodium dodecylbenzene sulfonate, for example NEOGEN R™ or NEOGEN SC™, and a nonionic surfactant, such as alkyl phenoxy poly(ethylenoxy)ethanol, for example IGEPAL 897™ or ANTAROX 897™, and which latexes contain resins with a particle size of from, for example, about 0.05 to about 1.0 micron in volume average diameter as measured by the Brookhaven nanosizer, and wherein mixing of the latex emulsion, and colorant dispersion induces flocculation of the reaction mixture, and which flocculent mixture on heating at a temperature from about 25° C. below to about 1° C. below about the Tg of the linear latex polymer results in the formation of toner sized aggregates ranging in size from about 2 microns to about 20 microns in volume average diameter as measured by the Coulter Counter; subsequently heating the resulting aggregate suspension at about 10° C. to about 50° C. above the Tg of the latex polymer in the presence of optional additional anionic surfactant to convert the aggregates into mechanically stable toner particles. Toners prepared in accordance with the present invention enable in embodiments generation of high quality images, and the use of low fusing temperatures, such as from about 100° C. to about 175° C., or more generally from about 120° C. to about 150° C., thereby eliminating or minimizing paper curl while prolonging the life of fuser roll, or higher copying or printing speeds, such as from about 25 to over 100 copies/prints per minute, thereby enhancing the printer/copier's productivity.

The present invention is also directed to processes for the preparation of toner compositions by initially blending an aqueous colorant dispersion containing a dye, pigment or pigments, such as carbon black like REGAL 330®, phthalocyanine, quinacridone or RHODAMINE B™, and a cationic surfactant, such as benzalkonium chloride, by means of a high shearing device, such as a Brinkmann polytron, a sonicator or microfluidizer, with a mixture of latexes, one comprised of linear uncrosslinked polymer particles in the amount of, for example, from about 50 to about 95 percent by weight, and a second comprised of soft crosslinked polymer in an amount of, for example, from about 5 to about 50 percent by weight, and which latexes contain an anionic surfactant, such as sodium dodecylbenzene sulfonate and a nonionic surfactant; heating the resultant flocculent mixture with stirring at a temperature of from about 25° C. to about 1° C. below the Tg of the linear latex polymer to form toner sized aggregates having volume average diameter of from about 2 to 20 microns; and further heating the mixture at a temperature of from about 10° C. to about 50° C. above the Tg of the linear latex polymer to effect fusion or coalescence of the components of the aggregates to form integral toner particles; followed by cooling and recovery of the toner, and thereafter washing with, for example, water to remove, for example, surfactants, and drying, such as by means of an oven, Aeromatic fluid bed dryer, freeze dryer, or spray dryer. The latex particles can be derived, or generated from the emulsion polymerization of suitable vinyl monomers, such as styrene, acrylate, methacrylate, butadiene, isoprene, chloroprene, acrylonitrile, acrylic acid, methacrylic acid, and the like, and with regard to the crosslinked latex polymer particles, the same, or similar monomers in the presence of an appropriate crosslinker such as divinylbenzene.

Toner compositions comprised of linear and crosslinked polymers, and pigment can be prepared by (i) blending a pigment dispersion containing an ionic surfactant with a latex emulsion comprised of a mixture of linear and crosslinked polymer particles, a nonionic surfactant, and an ionic surfactant that is of opposite charge polarity to the ionic surfactant in the pigment dispersion;

(ii) heating the resulting homogenized mixture at a temperature of from about 35° C. to about 60° C., thereby effecting formation of toner sized aggregates with, for example, a volume average diameter of from about 2 to about 20 microns, and a particle size distribution of less than about 1.35, and preferably between about 1.10 and about 1.25; and thereafter (iii) heating the aggregate suspension with additional ionic surfactant of opposite charge polarity to that in the pigment dispersion to a temperature of, for example, about 75° C. to about 100° C. to enable fusion or coalescence of the components of aggregates; cooling to, for example, about 25° C.; and subsequently (iv) isolating the toner product by washing and drying using appropriate conventional known techniques, such as washing with water, and drying in an oven; or by (i) preparing an aqueous pigment dispersion comprised of a pigment, an ionic surfactant, and optionally a charge control agent;

(ii) mixing the pigment dispersion with a latex blend comprised of linear polymer and crosslinked polymer, a nonionic surfactant and an ionic surfactant with a charge polarity opposite to that of ionic surfactant in said pigment dispersion, thereby causing flocculation of latex, pigment and optional additive particles; and wherein the pigment possesses, for example, a volume average diameter of from about 0.01 to about 1 micron, and the latex blend contains from about 5 to about 50 weight percent crosslinked latex particles having a particle size of from about 0.05 to about 1 micron in volume average diameter.

(iii) heating the resulting flocculent suspension at a temperature of, for example, from about 25° C. to about 1° C. below the Tg of the linear latex polymer to effect formation of toner sized aggregates;

(iv) heating the resulting aggregate suspension in the presence of additional surfactant of opposite charge polarity to that in the pigment dispersion, and more specifically, at temperatures of about 20° C. to 50° C. above the resin Tg of, for example, about 45° C. to about 65° C. to enable fusion or coalescence of the components of aggregates; cooling; and (v) separating the toner particles by filtration, and drying the toner particles in an oven or other appropriate drying device.

In embodiments of the present invention, the toner compositions contain from about 50 to about 95 weight percent, and more specifically, from about 70 to about 85 weight percent of linear latex polymer, and from about 5 to about 50 weight percent, and more specifically, from about 30 to about 15 weight percent of the crosslinked latex polymer particles, and wherein the total thereof is about 100 percent, from about 1 to about 15 percent by weight of colorant like pigment or pigments, and optionally from about 0 to about 5 weight percent of optional additives and wherein the total of all toner components, excluding the external additives, is 100 percent, or 100 parts.

Both the linear and crosslinked polymers selected are generally similar in chemical composition except for the noncrosslinked, or crosslinked structure. Examples of linear polymers include those prepared by emulsion polymerization of styrene and its derivatives, dienes, acrylates, methacrylates, acrylonitrile, acrylic acid methacrylic acid, with the dienes being preferably butadiene, isoprene, chloroprene, and the like, the acrylates being preferably methyl acrylate, ethyl acrylate, propyl acrylate, butyl acrylate, pentyl acrylate, ethylhexyl acrylate and the like, and the methacrylates being preferably methyl methacrylate, ethyl methacrylate, propyl methacrylate, butyl methacrylate, and the like.

The crosslinked polymers are similar to, or the same as the linear polymers except that the crosslinked polymer is generated by the use of a known crosslinker, such as divinylbenzene, during the polymerization. The crosslinker is generally present in an effective amount of, for example, from about 0.01 percent by weight to about 15 percent by weight, and preferably about 0.5 to about 10 percent by weight.

The fusing characteristics of the toners of the present invention are dependent on, for example, the chemical composition, crosslinked density, amount of components, Tg, and particle size of the crosslinked polymer particles in the toner composition and more importantly on the amount of acrylate present. In embodiments of the present invention, an effective crosslink density of the latex is provided by incorporating from about 0.01 to about 15 weight percent of a divinyl monomer, such as divinyl benzene, during emulsion polymerization, and an effective amount of crosslinked polymer particles for incorporation ranges from about 5 to over 50 weight percent, with 10 to 30 weight percent being preferred.

Illustrative examples of linear latex polymers selected for the process of the present invention include known addition polymers such as poly(styrene-butadiene), poly (methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly (butylacrylate-butadiene), poly(styrene-isoprene), poly (methyl styrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly (butylacrylate-isoprene), poly(styrene-butylacrylate), poly (styrene-propylacrylate), poly(styrene-ethylacrylate, poly (styrene-butylacrylate-acrylic acid), poly(styrene-propylacrylate-acrylic acid); polymers such as poly(styrene-butadiene-acrylic acid), poly(styrene-butadiene-methacrylic acid), PLIOTONE™ available from Goodyear, and the like. The combined linear and crosslinked latex polymers selected are present in various effective amounts, such as from about 80 weight percent to about 98 weight percent of the toner composition, and wherein latex size can be, for example, from about 0.01 micron to about 1 micron in volume average diameter as measured by the Brookhaven nanosize particle analyzer.

Various known colorants or pigments present in the toner in an effective amount of, for example, from about 1 to about 15 percent by weight of the toner, and preferably in an amount of from about 3 to about 10 weight percent, that can be selected include carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E. D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E. I. DuPont de Nemours & Company, and the like. Generally, colored pigments that can be selected are cyan, magenta, or yellow pigments, and mixtures thereof. Examples of magentas include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra (octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as pigments with the process of the present invention.

Colorant includes pigments, dyes, mixtures thereof, mixtures of pigments, mixtures of dyes, and the like.

Surfactants in embodiments include, for example, nonionic surfactants, such as dialkylphenoxypoly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. An effective concentration of the nonionic surfactant is in embodiments, for example from about 0.01 to about 10 percent by weight, and preferably from about 0.1 to about 5 percent by weight of monomers, used in latex emulsion preparation.

Examples of ionic surfactants include anionic and cationic surfactants with examples of anionic surfactants being, for example, sodium dodecyl sulfate, sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained-from Kao, and the like. An effective concentration of the anionic surfactant generally employed is, for example, from about 0.01 to about 10 percent by weight and preferably from about 0.1 to about 5 percent by weight of monomers used to prepare the latex emulsions.

Examples of the cationic surfactants selected for the toners and processes of the present invention include, for example, dialkyl benzenealkyl ammonium chloride, lauryl trimethyl ammonium chloride, alkyl benzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™ available from Alkaril Chemical Company, SANIZOL™ (benzalkonium chloride), available from Kao Chemicals, and the like, and mixtures thereof. This surfactant is utilized in various effective amounts, such as for example from about 0.1 percent to about 5 percent by weight of water. Preferably, the molar ratio of the cationic surfactant used for flocculation to the anionic surfactant used in the latex preparation is in the range of from about 0.5 to about 4, and preferably from 0.5 to 2.

Examples of additional optional surfactants, which can be added to the aggregate suspension to primarily stabilize the aggregates from further growing in size during the coalescence can be selected from anionic surfactants of, for example, sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, and the like; and nonionic surfactants such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol, available from Rhone-Poulenac as IGEPAL CA-210™, IGEPAL CA520™, IGEPAL CA-720™, IGEPAL CO-890™, IGEPAL CO-720™, IGEPAL CO-290™, IGEPAL CA-210™, ANTAROX 890™ and ANTAROX 897™. An effective concentration of the anionic or nonionic surfactant as an aggregate stabilizer is, for example, from about 0.01 to about 10 percent by weight, and preferably from about 0.5 to about 5 percent by weight of the total reaction mixture.

Cleavable nonionic surfactants, such as disclosed in the copending applications U.S. Ser. No. 960,754, and U.S. Ser. No. 960,176, the disclosures of which are totally incorporated herein by reference, can also be utilized in the preparation of both the linear and crosslinked latexes for generating the toners of the present invention.

The toner may also include known charge additives in effective amounts of, for example, from 0.1 to 5 weight percent such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference, negative charge enhancing additives like boron, aluminum, zinc and chromium complexes of salicylic acids, and the like. Other known charge additives may be selected.

Surface additives that can be added to the toner compositions after isolating the toner, and optionally washing or drying include, for example, metal salts, metal salts of fatty acids, colloidal silicas, metal oxides like titanium dioxide, mixtures thereof, and the like, which additives are each usually present in an amount of from about 0.1 to about 3 weight percent, reference U.S. Pat. Nos. 3,590,000; 3,720,617; 3,655,374 and 3,983,045, the disclosures of which are totally incorporated herein by reference. Preferred additives include zinc stearate and the silicas, available from Cabot Corporation, and Degussa Chemicals, such as AEROSIL R972® available from Degussa, and which additives are each preferably selected in amounts of from 0.1 to 2 percent and can be added during the aggregation or washing process, or blended into the final toner product.

Developer compositions can be prepared by mixing the toners obtained with the processes of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration.

Imaging methods are also envisioned with the toners of the present invention, reference for example a number of the patents mentioned herein, and U.S. Pat. Nos. 4,585,884; 4,563,408; 4,584,253, and 4,265,660, the disclosures of which are totally incorporated herein by reference.

The following Examples are being provided. These Examples are intended to be illustrative only and are not intended to limit the scope of the present invention. Percents are by weight unless otherwise indicated and temperatures are in degrees Centigrade.

EXAMPLE I

A latex emulsion (a) comprised of linear polymer particles derived from emulsion polymerization of styrene, butyl acrylate and acrylic acid was prepared as follows. A mixture of 492.0 grams of styrene, 108.0 grams of butyl acrylate, 12.0 grams of acrylic acid, 6.0 grams of carbon tetrabromide and 18.0 grams of dodecanethiol was added to an aqueous solution prepared from 6.0 grams of ammonium persulfate in 200 milliliters of water and 700 milliliters of an aqueous solution containing 13.5 grams of anionic surfactant, NEOGEN R™ and 12.9 grams of nonionic surfactant, ANTAROX CA 897™. The resulting mixture was homogenized at room temperature of about 25° C. under a nitrogen atmosphere for 30 minutes. Subsequently, the mixture was stirred and heated to 70° C. at a rate of 1° C. per minute, and retained at this temperature for 6 hours. The resulting latex polymer of styrene-butylacrylate-acrylic acid composition possessed an $M_w$ of 25,900 and an $M_n$ of 5,400 as determined by gel permeation chromatography GPC analysis with polystyrene standards, and a mid-point Tg of 55.9° C. as measured by differential scanning calorimetry.

A second latex emulsion (b) comprised of soft crosslinked polymer particles was prepared in accordance with the above procedure from 270.0 grams of styrene, 300.0 grams of butyl acrylate, 12.0 grams of acrylic acid, and 30.0 grams of divinyl benzene, without the chain transfer agents, carbon tetrabromide and dodecanethiol.

234.0 Grams of the latex emulsion (a), 26.0 grams of the crosslinked latex emulsion (b), and 230.0 grams of an aqueous cyan pigment dispersion containing 4.0 grams of Cyan Pigment 15.3 and 2.6 grams of cationic surfactant SANIZOL B™ were simultaneously added to 400 milliliters of water with high shear stirring by means of a polytron. The mixture was transferred to a 2 liter reaction vessel and heated at a temperature of 50° C. for 1.0 hour before 30 milliliters of 16 percent aqueous NEOGEN R™ solution were added. Subsequently, the mixture was heated to 95° C. and retained at this temperature for a period of 4 hours. The resulting toner product was filtered, washed with water, and dried in a freeze dryer. The resulting toner, which was comprised of about 86.7 weight percent of the linear polymer resin, about 9.6 weight percent of the soft crosslinked polymer particles, and about 3.7 weight percent of cyan pigment, evidenced a particle size of 6.7 microns in volume average diameter and a particle size distribution of 1.20, both as measured with a Coulter Counter.

Standard fusing properties of the toner were evaluated as follows. Unfused images of toner on paper with a controlled toner mass per unit area of 1.2 mg/cm$^2$ were produced in accordance with the following procedure. A suitable electrophotographic developer was generated by mixing from 2 to 10 percent by weight of the toner with a suitable electrophotographic carrier, such as, for example, a 90 micron diameter ferrite core, spray coated with 0.5 weight percent of a terpolymer of poly(methyl methacrylate), styrene, and vinyltriethoxysilane, and roll milling the mixture for 10 to 30 minutes to produce a toner tribocharge of between −5 to −20 microcoulombs per gram of toner as measured with a Faraday Cage. The developer was then introduced into a small electrophotographic copier, such as a Mita DC-111, in which the fuser system had been disconnected. Between 20 and 50 unfused images of a test pattern of a 65 millimeters by 65 millimeters square solid area were produced on 8½ by 11 inch sheets of a typical electrophotographic paper, such as Xerox Corporation Image LX© paper.

The unfused images were then fused by feeding them through a hot roll fuser system comprised of a fuser roll and pressure roll with Viton surfaces, both of which were heated to a controlled temperature. Fused images were produced over a range of hot roll fusing temperatures of from about 120° C. to about 210° C. The degree of permanence of the fused images was evaluated by the known Crease Test. The fused image was folded under a specific weight with the toner image to the inside of the fold. The image was then unfolded and any loose toner wiped from the resulting crease with a cotton swab. The average width of the paper substrate, which shows through the fused toner image in the vicinity of the crease, was measured with a custom built image analysis system.

The fusing performance of a toner is traditionally judged from the fusing temperature required to achieve acceptable image fix. The minimum fuser temperature required to produce a crease value less than the maximum acceptable crease of traditionally 65 crease units is known as the Minimum Fix Temperature (MFT) for a toner.

The toner obtained in this Example was evaluated in accordance with the procedure, and an MFT of 142° C. was obtained.

EXAMPLE II 208.0 Grams of the latex emulsion (a) from Example I, 52.0 grams of the latex emulsion (b) from Example I, and 230.0 grams of an aqueous cyan pigment dispersion containing 4.0 grams of Cyan Pigment 15.3 and 2.6 grams of cationic surfactant SANIZOL B™ were simultaneously added to 400 milliliters of water with high shear stirring by means of a polytron. The mixture was transferred to a 2 liter reaction vessel and heated at a temperature of 50° C. for 2.0 hours before 27 milliliters of 16 percent aqueous NEOGEN R™ solution were added. Subsequently, the mixture was heated to 95° C. and held there for a period of 3.5 hours, before cooling down to room temperature. The toner product was filtered, washed with water, and dried in an oven. The resulting toner, which was comprised of about 77 weight percent of linear polymer resin, about 19.3 weight percent of crosslinked polymer particles, and about 3.7 weight percent of cyan pigment, evidenced a particle size of 6.7 microns in volume average diameter with a particle size distribution of 1.18 as measured with a Coulter Counter. When evaluated in accordance with the procedure of Example I, the toner displayed an MFT of 139° C.

EXAMPLE III

182 Grams of the latex emulsion (a) from Example I, 78 grams of the latex emulsion (b) from Example I, and 230.0 grams of an aqueous cyan pigment dispersion containing 4.0 rams of Cyan Pigment 15.3 and 2.6 grams of cationic surfactant SANIZOL B™ were simultaneously added to 400 milliliters of water with high shear stirring by means of a polytron. The mixture was transferred to a 2 liter reaction vessel and heated at a temperature of 50° C. for 2.0 hours before 27 milliliters of 16 percent aqueous NEOGEN R™ solution were added. Subsequently, the mixture was heated to 95° C. and held there for a period of 3.5 hours, before cooling down to room temperature. The toner product was filtered, washed with water, and dried in an oven. The resulting toner, which was comprised of about 67.4 weight percent of linear polymer resin, about 28.9 weight percent of crosslinked polymer particles, and about 3.7 weight percent of cyan pigment evidenced a particle size of 6.5 microns in volume average diameter with a GSD of 1.16 as measured with a Coulter Counter. When evaluated in accordance with the procedure of Example I, the toner displayed an MFT of 135° C.

Comparative Example A 260.0 Grams of the latex emulsion (a) from Example I and 230.0 grams of an aqueous cyan pigment dispersion containing 4.0 grams of Cyan Pigment 15.3 and 2.6 grams of cationic surfactant SANIZOL B™ were simultaneously added to 400 milliliters of water with high shear stirring by means of a polytron. The mixture was transferred to a 2 liter reaction vessel and heated at a temperature of 50° C. for 1.0 hour before 28 milliliters of 16 percent aqueous NEOGEN R™ solution were added. Subsequently, the mixture was heated to 95° C. and retained at this temperature for a period of 4 hours, before cooling down to room temperature and filtered. The toner product was washed with water and dried in a freeze dryer. The resulting toner, which was comprised of about 96.3 weight percent of linear polymer resin and about 3.7 weight percent of cyan pigment, showed a particle size 6.6 microns in volume average diameter, and a particle size distribution of 1.20 as measured with a Coulter Counter. The toner, when evaluated in accordance with the procedure of Example I, exhibited an MFT of 152° C.

Comparative Example B

A latex emulsion (c) comprised of hard crosslinked polymer particles, reference for example copending application U.S. Ser. No. 841,300, was prepared from 455.0 grams of styrene, 35.0 grams of divinyl benzene, 110 grams of butyl acrylate, and 12.0 grams of acrylic acid in accordance with the procedure for the preparation of latex emulsion (b) as described in Example I.

78.0 Grams of the latex emulsion (c), 182.0 grams of the latex emulsion (a) from Example I, and 230.0 grams of an aqueous cyan pigment dispersion containing 4.0 grams of Cyan Pigment 15.3 and 2.6 grams of cationic surfactant SANIZOL B™ were simultaneously added to 400 milliliters of water with high shear stirring by means of a polytron. The resulting mixture was then transferred to a 2 liter reaction vessel and heated at a temperature of 53° C. for 2.0 hours before 35 milliliters of 20 percent aqueous NEOGEN R™ solution were added. Subsequently, the mixture was heated to 95° C. and retained at this temperature for a period of 4 hours, before cooling down to room temperature. The resulting toner was filtered, washed with water, and dried in an oven. The resulting toner product, comprised of about 67.4 weight percent of the liner polymer, about 28.9 weight percent of hard crosslinked polymer particles, and about 3.7 weight percent of Cyan Pigment 15:3 showed a particle size of 7.0 microns in volume average diameter with a GSD of 1.22 as measured with a Coulter Counter. When evaluated in accordance with the procedure of Example I, the toner displayed an MFT of 154° C., thus for the same amount of crosslinked latex this toner had a higher fusing temperature.

Other modifications of the present invention may occur to those of ordinary skill in the art subsequent to a review of the present application and these modifications, including equivalents thereof, are intended to be included within the scope of the present invention.

What is claimed is:

1. A process for the preparation of toner comprising (i) blending an aqueous colorant dispersion with a latex blend comprised of a linear polymer and a soft crosslinked polymer;

(ii) heating the resulting mixture at about below, or about equal to the glass transition temperature (Tg) of the linear latex polymer to form aggregates; and (iii) subsequently heating said aggregate suspension about above, or about equal to the Tg of the linear latex polymer to effect fusion or coalescence of said aggregates, and wherein said soft crosslinked polymer is flexible and contains an acrylate in an amount of from about 25 to about 70 weight percent.

2. A process in accordance with claim 1 wherein the colorant dispersion contains an ionic surfactant, and the latex blend contains an optional nonionic surfactant, and an ionic surfactant that is of opposite charge polarity to that of the ionic surfactant in said colorant dispersion.

3. A process in accordance with claim 1 wherein the linear latex polymer is poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly (alkyl methacrylate-alkyl acrylate), poly(alkyl methacrylate-aryl acrylate), poly(aryl methacrylate-alkyl acrylate), poly (alkyl methacrylate-acrylic acid), poly(styrene-alkyl acrylate-acrylonitrile-acrylic acid), poly(styrene-1,3-diene-acrylonitrile-acrylic acid), or poly(alkyl acrylate-acrylonitrile-acrylic acid).

4. A process in accordance with claim 1 wherein the soft crosslinked polymer is the crosslinked analog of the linear polymer containing a monomer of propyl, butyl acrylate, pentyl acrylate, hexyl acrylate, ethylhexyl acrylate, 1,3-diene, hexyl methacrylate, or mixtures thereof.

5. A process in accordance with claim 1 wherein the crosslinked polymer is a crosslinked poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), or poly(alkyl acrylate-acrylonitrile-acrylic acid).

6. A process in accordance with claim 1 wherein the soft crosslinked polymer is derived from the polymerization of styrene, butyl acrylate, acrylic acid and divinylbenzene.

7. A process in accordance with claim 1 wherein the crosslinked polymer is derived from polymerization of monomers selected from the group consisting of styrenes, acrylates, methacrylates, 1,3-dienes, acrylonitrile, acrylic acid, and methacrylic acid in the presence of a crosslinking compound.

8. A process in accordance with claim 6 wherein butyl acrylate is present in an amount of about 25 to about 70 percent by weight of the monomers.

9. A process in accordance with claim 1 wherein the crosslinked polymer is present in an amount of from about 5 to about 75 weight percent of the toner composition, and wherein the linear polymer is present in an amount of from about 25 to about 95 weight percent of toner composition.

10. A process in accordance with claim 1 wherein the crosslinked polymer is present in an amount of from about 10 to about 50 weight percent of toner composition, and wherein the linear polymer is present in an amount of from about 50 to about 90 weight percent of toner composition.

11. A process in accordance with claim 1 wherein the toner exhibits a low fusing temperature of from about 120° C. to about 145° C.

12. A process in accordance with claim 1 wherein the colorant dispersion contains a cationic surfactant, and the latex blend contains a nonionic surfactant and an anionic surfactant.

13. A process in accordance with claim 1 wherein the colorant dispersion contains an anionic surfactant and the latex blend contains a nonionic surfactant and a cationic surfactant.

14. A process in accordance with claim 1 wherein the aggregation (ii) is accomplished at temperatures of from about 25° C. to about 1° C. below the Tg of the linear polymer for a duration of from about 0.5 hour to about 5 hours.

15. A process in accordance with claim 14 wherein the linear polymer is poly(styrene-butyl acrylate), poly(styrene-butyl acrylate-acrylic acid), poly(styrene-butadiene), poly (styrene-butadiene-acrylic acid), poly(styrene-butyl acrylate-acrylonitrile), or poly(styrene-butyl acrylate-acrylonitrile-acrylic acid), and the crosslinked resin is the crosslinked derivative of poly(styrene-butyl acrylate), poly (styrene-butyl acrylate-acrylic acid), poly(styrene-butyl acrylate-acrylonitrile), or poly(styrene-butyl acrylate-acrylonitrile-acrylic acid).

16. A process in accordance with claim 12 wherein the nonionic surfactant is selected from the group consisting of polyvinyl alcohol, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, and dialkylphenoxy poly(ethyleneoxy)ethanol; and wherein the anionic surfactant is selected from the group consisting of sodium dodecyl sulfate, sodium dodecylbenzene sulfate, sodium dodecylnaphthalene sulfate, and the cationic surfactant is a quaternary ammonium salt.

17. A process in accordance with claim 1 wherein the colorant is carbon black, magnetite, cyan, yellow, magenta, and mixtures thereof.

18. A process in accordance with claim 2 wherein the surfactants are each present in an effective amount of from about 0.1 to about 5 weight percent of the reaction mixture.

19. A process in accordance with claim 1 wherein there is added to the surface of the formed toner metal salts, metal salts of fatty acids, silicas, metal oxides, or mixtures thereof each in an amount of from about 0.1 to about 10 weight percent of the obtained toner particles.

20. A process in accordance with claim 1 wherein after cooling the toner is isolated, washed with water or an aqueous base solution at a temperature of from about 25° C. to about 75° C. to remove the residual surfactants from the toner, and wherein the fusion or coalescence is accomplished at a temperature of from about 65° C. to about 100° C.

21. A process in accordance with claim 1 wherein subsequent to (iii) cooling is accomplished, and the toner is isolated, washed, and dried.

22. A process for the preparation of toner comprising heating a mixture of an aqueous colorant dispersion containing a first ionic surfactant, and a latex blend comprised of linear polymer and soft crosslinked polymer particles, a nonionic surfactant and a second ionic surfactant with a charge polarity opposite to that of said ionic surfactant in said colorant dispersion; heating the resulting mixture at about below the glass transition temperature (Tg) of the linear latex polymer to form toner sized aggregates; and subsequently heating said aggregates about above the Tg of the linear latex polymer to effect coalescence of said aggregates, followed by optionally isolating said toner, and optionally washing said toner, and wherein said soft crosslinked polymer particles contain from about 25 to about 70 weight percent of an acrylate.

23. A process in accordance with claim 22 wherein the crosslinked polymer particles are present in amounts of from about 5 percent to about 75 percent by weight of the toner, and wherein the linear polymer particles are present in an amount of from about 25 to about 95 by weight of the toner.

24. A process in accordance with claim 1 wherein said soft crosslinked polymer contains acrylate in an amount of about 25 to about 55 percent by weight of the latex monomers.

25. A process in accordance with claim 1 wherein said acrylate is present in an amount of from about 25 to about 55 weight percent.

26. A process in accordance with claim 1 wherein said soft crosslinked polymer is comprised of styrene, butyl acrylate and acrylic acid.

27. A process in accordance with claim 26 wherein said polymer is crosslinked with divinyl benzene.

* * * * *